United States Patent [19]

Pearson

[11] 4,073,327

[45] Feb. 14, 1978

[54] MAGNETIC HEAD HAMMER

[76] Inventor: Ottis D. Pearson, 104 Gillcrest Ave., Vallejo, Calif. 94590

[21] Appl. No.: 695,088

[22] Filed: June 11, 1976

[51] Int. Cl.[2] ..... B25C 1/00; B25D 1/00

[52] U.S. Cl. ..... 145/30 A

[58] Field of Search ..... 145/30 A, 50 DA, 30 R

[56] References Cited

U.S. PATENT DOCUMENTS

| | | | |
|---|---|---|---|
| 29,760 | 8/1860 | Boeklen | 145/30 A |
| 2,597,876 | 5/1952 | Kurkjian | 145/30 A |
| 2,624,223 | 1/1953 | Clark | 145/50 DA |
| 2,671,483 | 3/1954 | Clark | 145/50 DA |
| 2,718,806 | 9/1955 | Clark | 145/50 DA |
| 2,806,396 | 9/1957 | Miller | 145/50 DA |
| 3,580,312 | 5/1971 | Hallock | 145/30 A |

FOREIGN PATENT DOCUMENTS

| | | | |
|---|---|---|---|
| 235,767 | 9/1964 | Austria | 145/30 A |
| 1,293,018 | 4/1962 | France | 145/50 DA |
| 1,115,035 | 12/1955 | France | 145/30 A |

*Primary Examiner*—Gary L. Smith
*Assistant Examiner*—J. T. Zatarga
*Attorney, Agent, or Firm*—Alfons Puishes

[57] ABSTRACT

A more or less conventional claw hammer is equipped with a special magnetic insert in its head for convenience in picking up nails and tacks prior to driving with the hammer. The special magnetic insert is comprised of high carbon hardened steel which is heat treated prior to magnetizing and then press-fitted into a hard metal non-magnetic shield and the assembly is further pressed into a recess in the hammer head presenting a flush face which may then perform the combined functions of magnetic pick-up and driving over long periods of time without impairing the function of the magnet.

2 Claims, 4 Drawing Figures

MAGNETIC HEAD HAMMER

BACKGROUND OF THE INVENTION

In my co-pending patent application Ser. No. 654,371 I disclose a combination nail starting and driving tool. This invention comprises essentially a two-headed tool having a driving head composed of conventional heat treated steel and on the opposite axial end a magnetic head having a magnetic insert for use in picking up nails and tacks and starting them in the material to be fastened prior to driving with the opposite end.

This combination represented a vast improvement over old style tack hammers having a magnetized head. These old devices were quite useful but were inclined to rapidly lose their magnetism after some hammering. My earlier invention avoided this disadvantage by providing a combination in which the magnetic or pick-up end of the tool is used only for picking up the nail or tack and getting it started. The final hammering or nailing was done by swiveling the tool through 180° and utilizing the driving end. This tool has proved particularly advantageous in light work or elevated work where only one hand is available for the hammering operation. The latter could be carried out quite effectively without impairing the efficiency of the magnet. Prolonged hammering on the magnet end with this device would still result in loss of magnetism.

SUMMARY OF THE INVENTION

I have now discovered that I may provide a magnetic insert or a magnetic head hammer in which the same hammer head may be used for pick-up and starting of the nails or tacks as well as hammering them home. This I accomplish by utilizing a hardened steel magnetic insert pressed into a shield of non-magnetic hard material such as austenitic stainless steel or other high nickel alloys known for their hardness, durability and non-magnetic properties. The combination of shield and magnetic insert are then heavily press-fitted into a recess in the head of a conventional hammer, the face of which is then ground off to present a smooth surface. The use of the magnetized hardened steel insert plus the effect of very tightly enclosing it in the shield and tightly pressing it into the hammer head produces the effect of having the magnetic insert retain its magnetism over a very long period of time despite the impact on the head of the hammer when used.

I have discovered that for some reason very violent hammering on hard material over a great many repetitions for a long period of time does not diminish the magnetic properties of the head to any perceptible degree. I have discovered also that the actual force of the magnetism provided by such a head is actually increased many-fold by this combination and construction.

DESCRIPTION OF A PREFERRED EMBODIMENT

Referring now to the figures, there is seen first the hammer handle 1 which may be of conventional wooden construction. The hammer head 2 is equipped with an also conventional claw end 3.

Figure 3:
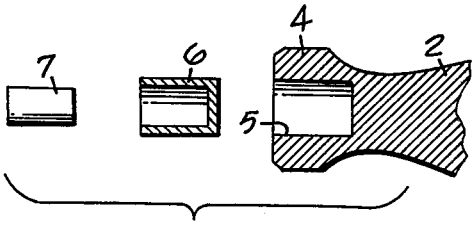
FIG. 3 is an exploded partial side view of the head and its principal components.
Figure 4:
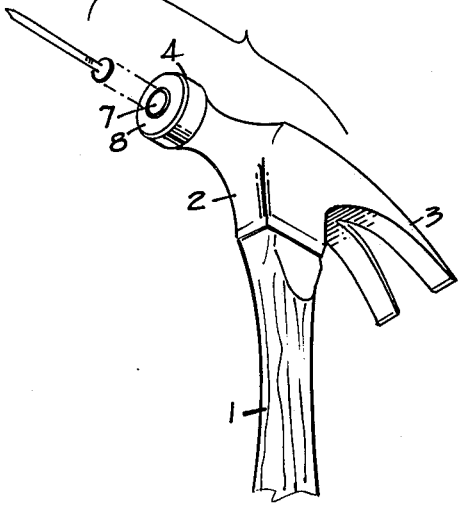
FIG. 4 is an isometric showing diagrammatically the operation of the magnetic head on a nail.

In the driving end 4 I provide a cylindrical axial recess or counterbore 5. In a typical application I may make this counterbore one-half inch diameter and one-half inch deep. I then provide a shield which is generally of thimble-like or cup-like configuration 6, having an open end and a closed end as seen best on FIG. 3. In the typical application I may make this member with an outside diameter of one-half inch and the length of one-half inch allowing proper tolerance in the outside diameter to provide a heavy press-fit into the hammer head. The inside diameter of this member may be three-eighths of an inch. I next provide a cylindrically shaped hardened steel magnetic insert 7. This I make of high carbon steel which is heat treated, hardened and ground to the proper dimensions and then magnetized by subjecting it to the action of a magnetic flux to the saturation point. In the illustration given here my insert would be one-half inches long and three-eighths of an inch in outside diameter, again allowing the proper tolerance for a heavy press-fit into the shield. The walls of the latter would thus have a thickness of one-sixteenth of an inch.

I next press insert 7 into shield 6 by means of an arbor press or similar machine and then press the combination into recess 5 in hammer head 4.

Figure 2:
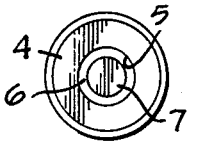
FIG. 2 is an end view of the hammer of FIG. 1.
Figure 1:
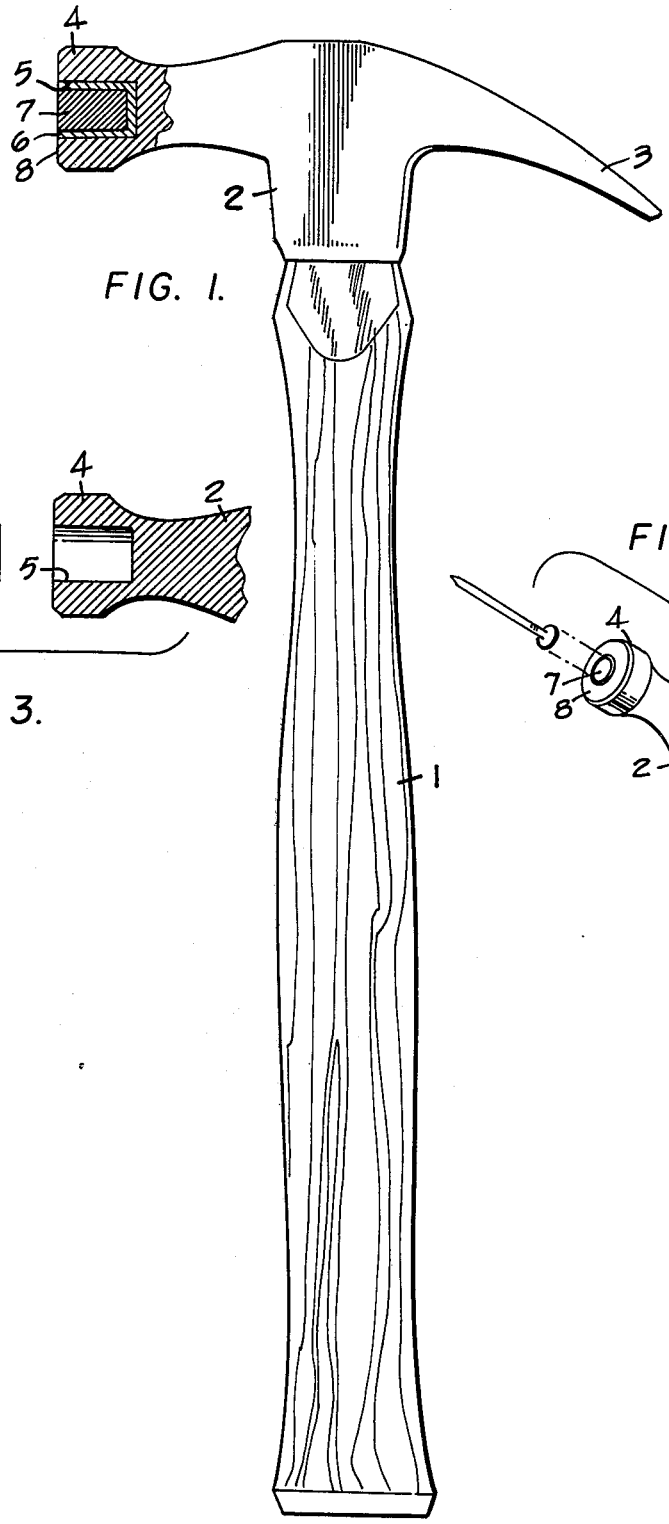
FIG. 1 is a side elevation of my hammer, partly in section, to show the head.

After thus assembling I may grind off the face of the hammer to present a flush driving face which may be seen on FIG. 1 and FIG. 2.

The material for my special magnetic shield thimble 6 must be of a hard, tough, and non-magnetic material. I have found that a number of the stainless steels of the austenitic type, having various ranges of nickel and chromium are satisfactory for this purpose. These may be hardened by cold working to obtain the desired properties for this application.

The hammer head itself is, of course, of conventional forged steel construction and depending on the material used, the counterbore 5 may be made prior to any later heat treatment which it is desired to effect on the head itself. After the latter heat treatment, if any, the magnetic components are inserted as described above.

The use of this combination in the manner set forth above produces the unusual and unexpected results on the finished product. The tight confinement of the previously hardened and magnetized insert 7 within the magnetic shield thimble 6 and the recess 5 produces two effects. The first of these is to tremendously increase the magnetic pull of the insert 7. The second is to cause the insert to retain its magnetic pull over a very long period of time despite heavy hammering and pounding of the head.

In this manner I am able to realize the many advantages of my previous invention described above and in addition improve on them to a very great extent. The increased safety, ease of operation, and convenience, as well as a tremendous saving in labor costs and permitting one arm operation should now be evident to those skilled in the art.

As with my previous tool, suitable receptacles may be employed for holding the nails or tacks prior to their use. These may be such that the nails or tacks are permitted to slide down one at a time from suitable chute where they are picked up by the magnetic head or they may be placed in a container in a vertical position with only the heads exposed so that they may be readily picked up and driven home. These receptacles may be placed on the ladder or scaffold if necessary or they may be equipped for fastening on the person of the worker using my tool.

I claim:

1. A hammer having a magnetic driving head said head comprising:

a drop-forged driving end of heat treated steel having a driving face positioned thereon;

a recessed section counterbored through said face in said end;

a shield member of relatively hard non-magnetic metal;

a permanent magnet member tightly pressed into said shield member;

said shield member and said magnetic member being tightly pressed into said recessed section to form a flush surface with said driving face; whereby said magnetic member forms a part of said driving face;

said magnetic member being further characterized by the complete absence of cushioning or impact absorbing means in connection therewith;

said shield member being further characterized by a cup-like configuration enclosing all but one surface of said magnetic member said one surface forming a part of said driving face.

2. The hammer of claim 1 in which said shield member is comprised of non-magnetic stainless steel.

* * * * *